US007025433B2

(12) United States Patent
Lopez et al.

(10) Patent No.: US 7,025,433 B2
(45) Date of Patent: Apr. 11, 2006

(54) CHANGING DROP-EJECTION VELOCITY IN AN INK-JET PEN

(75) Inventors: Matthew G. Lopez, Escondido, CA (US); Mark A. Overton, Escondido, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 151 days.

(21) Appl. No.: 10/306,589

(22) Filed: Nov. 27, 2002

(65) Prior Publication Data

US 2004/0100514 A1 May 27, 2004

(51) Int. Cl.
*B41J 29/38* (2006.01)

(52) U.S. Cl. ..... 347/9; 347/14

(58) Field of Classification Search ..... 347/9, 347/12, 14, 19, 78, 79; 400/74
See application file for complete search history.

(56) References Cited

U.S. PATENT DOCUMENTS 3,968,498 A 7/1976 Uchiyama
4,063,252 A * 12/1977 Jensen et al. ..... 347/6
4,313,123 A * 1/1982 Jinnai et al. ..... 347/75
4,381,514 A 4/1983 Calandrino
4,872,028 A 10/1989 Lloyd
5,212,497 A * 5/1993 Stanley et al. ..... 347/19
5,396,274 A 3/1995 Ortquist et al.
5,418,558 A 5/1995 Hock et al.
5,526,027 A 6/1996 Wade
5,781,202 A 7/1998 Silverbrook
5,781,205 A 7/1998 Silverbrook
5,796,416 A 8/1998 Silverbrook
6,086,190 A 7/2000 Schantz
6,113,221 A 9/2000 Weber
6,132,032 A 10/2000 Bryant
6,154,228 A * 11/2000 Okuda et al. ..... 347/15
6,161,926 A 12/2000 Shigemura et al.
6,217,155 B1 4/2001 Silverbrook
6,234,602 B1 5/2001 Soto
6,345,876 B1 2/2002 Tanaka
6,361,137 B1 3/2002 Eaton et al.
6,435,668 B1 8/2002 Barbour
6,454,376 B1 9/2002 Su et al.
6,454,383 B1 9/2002 Lund
6,467,867 B1 10/2002 Worthington et al.
6,669,324 B1 * 12/2003 King et al. ..... 347/19

FOREIGN PATENT DOCUMENTS

EP 1060898 12/2000

* cited by examiner

*Primary Examiner*—Thinh Nguyen

(57) ABSTRACT

An exemplary method, which can be used to reduce errors related to pen-to-pen misalignment and/or paper-shape variation, entails changing the drop-ejection velocity of an ink-jet pen.

23 Claims, 5 Drawing Sheets

CHANGING DROP-EJECTION VELOCITY IN AN INK-JET PEN

BACKGROUND

The advent of the information age has fueled widespread commercial, governmental, and personal use of computer printers, copiers, and facsimile machines. Although the full spectrum of these devices encompasses a variety of printing technologies, one of the most prevalent forms is thermal ink-jet printing.

Thermal inkjet printing generally entails applying a fixed amount of electrical energy, in the form of an electrical pulse, to a heater located near a small, ink-filled chamber. The heater heats a portion of the ink until it boils and forms an expanding bubble. The expanding bubble exerts increasing pressure on surrounding ink, ultimately expelling or ejecting some ink through a nozzle as a tiny drop. When the drop lands on paper, it forms a tiny dot, or pixel. (Paper, as used herein, refers to any form of print media.)

The heater-chamber-nozzle combination, generally called a pen, is often part of a printhead having several pens. For example, some color inkjet printers include a printhead with four rigidly positioned pens that respectively eject cyan, yellow, magenta, or black ink. These printers not only move or scan the printhead horizontally across the paper, but also move the paper vertically up or down relative to the printhead. Thus, by selectively moving the printhead and paper and selectively ejecting, or firing, ink drops, the printer forms images, such as text and pictures, on the paper.

The present inventors recognized that conventional inkjet printers (or more generally imaging systems) may exhibit mechanical imperfections that can cause drop-placement errors. For example, mass-produced printheads typically exhibit some degree of pen-to-pen misalignment. The misalignment forces drops to be ejected at different trajectories, which ultimately causes misalignment of printed dots and reduces image quality.

Another imperfection, known as paper-shape variation, refers to variations in the distance between the printhead and the paper. Paper-shape variation generally stems from shallow hills and valleys in the platen that supports the paper and/or from inconsistent contact of the paper with the platen. The significance of the variation stems from the fact that each pen in the printhead ejects its drops at substantially the same speed, or velocity (based on the fixed amount of energy applied to the pen) and ultimately reduces image quality.

One known way to address both pen-misalignment and paper-shape variation is to delay or advance the timing of the fixed electrical pulses that fire the ink drops and thus shift the landing point of the drops. See, for example, U.S. Pat. No. 6,361,137 (Eaton et al.), which is assigned to the same assignee as the present application and incorporated herein by reference. However, corrections with this approach are generally limited by the printing-grid resolution (or precision) of the printer. Thus, for example, in an ink-jet printer with a 2400 dot-per-inch (dpi) resolution, this pulse-shifting method cannot correct for placement errors less than 1/2400th of an inch.

DESCRIPTION OF EXEMPLARY EMBODIMENT(S)

The following detailed description, which incorporates the above-identified figures, describes and illustrates one or more specific embodiments of the invention. These embodiments, offered not to limit, but to exemplify and teach, are shown and described in sufficient detail to enable those skilled in the art to implement or practice the invention. Thus, where appropriate to avoid obscuring the invention, the description may omit certain information known to those of skill in the art.

Figure 1:
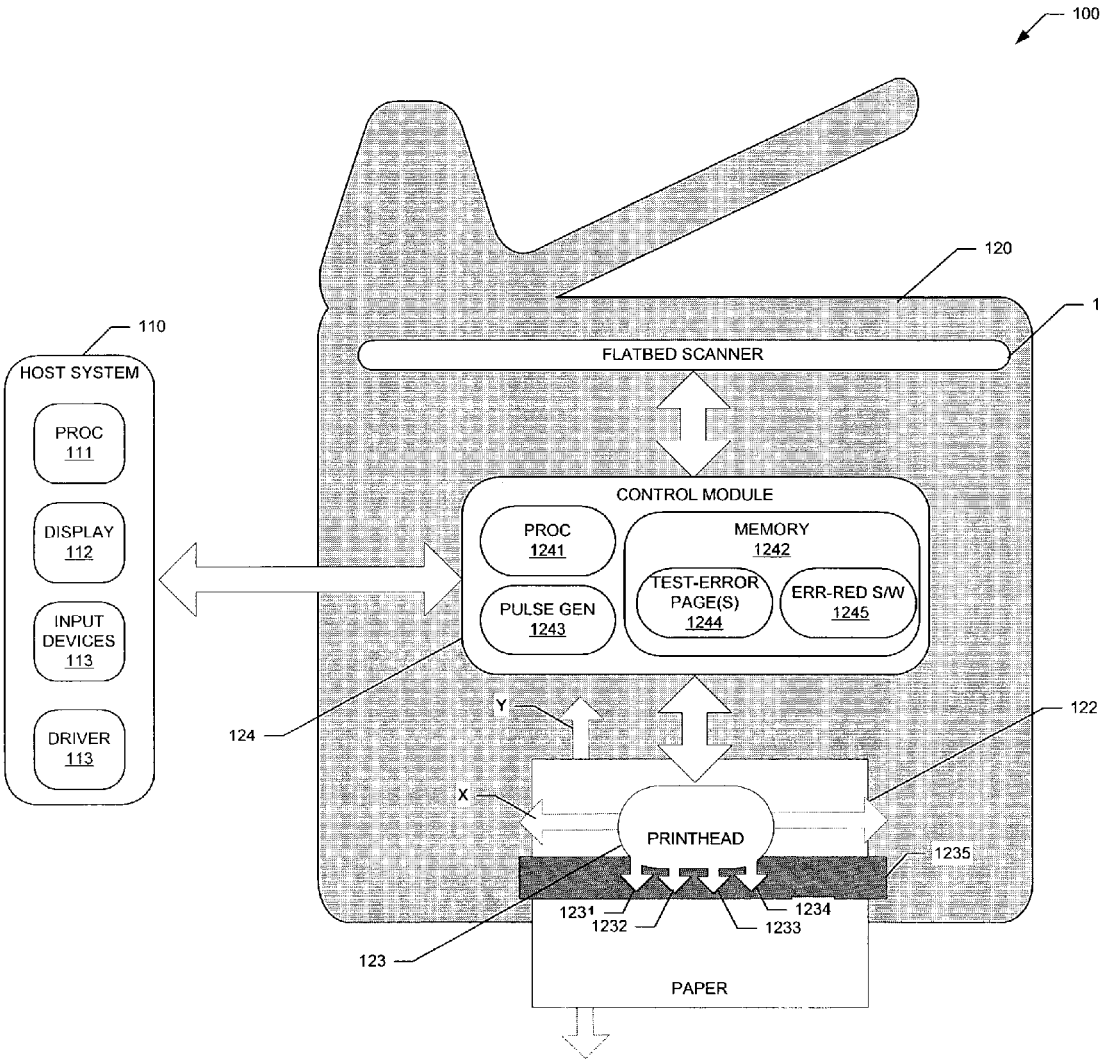
FIG. 1 is a block diagram of an exemplary ink-jet imaging system 100 corresponding to one or more embodiments of the present invention.

FIG. 1 shows an exemplary system 100 corresponding to one or more embodiments of the present invention. System 100 includes a host system 110 and an ink-jet printer (or more generally imaging device) 120. Computing device 110, which takes the form of a personal computer or workstation in some embodiments and a network appliance, personal digital assistant, or server in other embodiments, includes a processor 111, a display 112, input devices 113, and driver software 114. Driver software 114, in the exemplary embodiment, communicates 1200×1200 dpi render data via a wireline or wireless link to printer 120.

Printer 120 includes, among numerous other items (not shown), a scanner 121, paper 122, a printhead 123, and a control module 124. In the exemplary embodiment, printer 120 takes the form of an all-in-one printer, copier, scanner, fax device with a nominal print-grid resolution of 2400 dpi. Examples of such devices include HP OfficeJet D series systems from Hewlett Packard of Palo Alto, Calif. (HP, OfficeJet, and D series are trademarks of the Hewlett Packard.) Other embodiments of the invention use other types of hard-copy apparatus or imaging devices having lesser or greater functionality and capability than the HP OfficeJet D series device.

More particularly, scanner 121, which is accessible via a lid assembly as well as a sheet feeder (not shown), digitizes and copies documents. In the exemplary embodiment, scanner 121 has an optical resolution of 1200 dpi and scans in color.

Paper 122, in the exemplary embodiment is of the cut-sheet type. However, other embodiments use a continuous print media. Paper 122, which is movable via a paper transport system (not shown) along a vertical axis Y, includes a print zone 1235, which is located adjacent printhead 123.

Printhead 123, which is movable within print zone 1235 along a horizontal axis X substantially perpendicular to vertical axis Y, includes four ink-jet pens 1231, 1232, 1233, and 1234. In this exemplary embodiment, ink-jet pens 1231–1234 respectively apply cyan (C), yellow (Y), magenta (M), and black (K) colorants to paper 122 according to well known drop-on-demand thermal ink-jetting principles. (However, some other embodiments may use different printing technologies with controllable drop velocity.) Additionally, pens 1231–1234 are fixed in a substantially collinear arrangement subject to some degree of deviation from an exact collinear relation because of imperfect manufacture.

In some embodiments, each of the ink-jet pens is formed on a separate integrated-circuit die (not shown). Some other embodiments include greater or fewer numbers of pens and deliver different combinations of colorants and/or fixers. Also some embodiments stagger the pens to facilitate sequential firing. Printhead 123 and its constituent pens are controlled by control module 124. Control module 124 may include, among other things, a processor (or controller) 1241, a pulse-generator 1242, and a memory 1243. (In some embodiments, one or more portions of control module 124 are incorporated into printhead 123.) Processor or controller 1241, which may take the form of dedicated processor or one or more application-specific, integrated circuits (ASICs) provides computing and data processing capabilities for operating and controlling various components of printer 120, such as pulse generator 1242 in accord with one or more programs and data in memory 1243 (or elsewhere).

Pulse generator 1242 generates electrical pulses in accord with command and data signals from processor 1241. Pulse generator 1242 may include one more voltage regulators and one or more pulse-width-control circuits which are controlled via analog or digital means to set the height (amplitude) and width (duration) of each electrical pulse applied to each pen of printhead 123. In the exemplary embodiment, pulse-generator 1242 simultaneously applies pulses to each of the pens in printhead 123; however, other embodiments may apply the pulses sequentially.

Memory 1243, which may be volatile and/or non-volatile and may take any available form, such as electronic, magnetic, or optical, includes, among other things (not shown), error-test page(s) 1244 and error-reduction software 1245. Error-test page 1244 includes data and parameters (as detailed below) that facilitate operation of error-reduction software 1245.

Error-reduction software 1245 may include machine-readable and/or executable program code for causing processor 1241 (and/or other portions of printer 120) to modulate the absolute and/or relative drop-ejection velocities for the pens in printhead 123 to reduce printer errors related to mechanical imperfections. In the exemplary embodiment, the software adjusts relative drop-ejection velocities of one or more pairs of the pens to compensate for pen-to-pen misalignment and/or adjusts the drop-ejection velocities of all the pens based on position within print zone 1235 to compensate for paper-shape variation.

Figure 2:
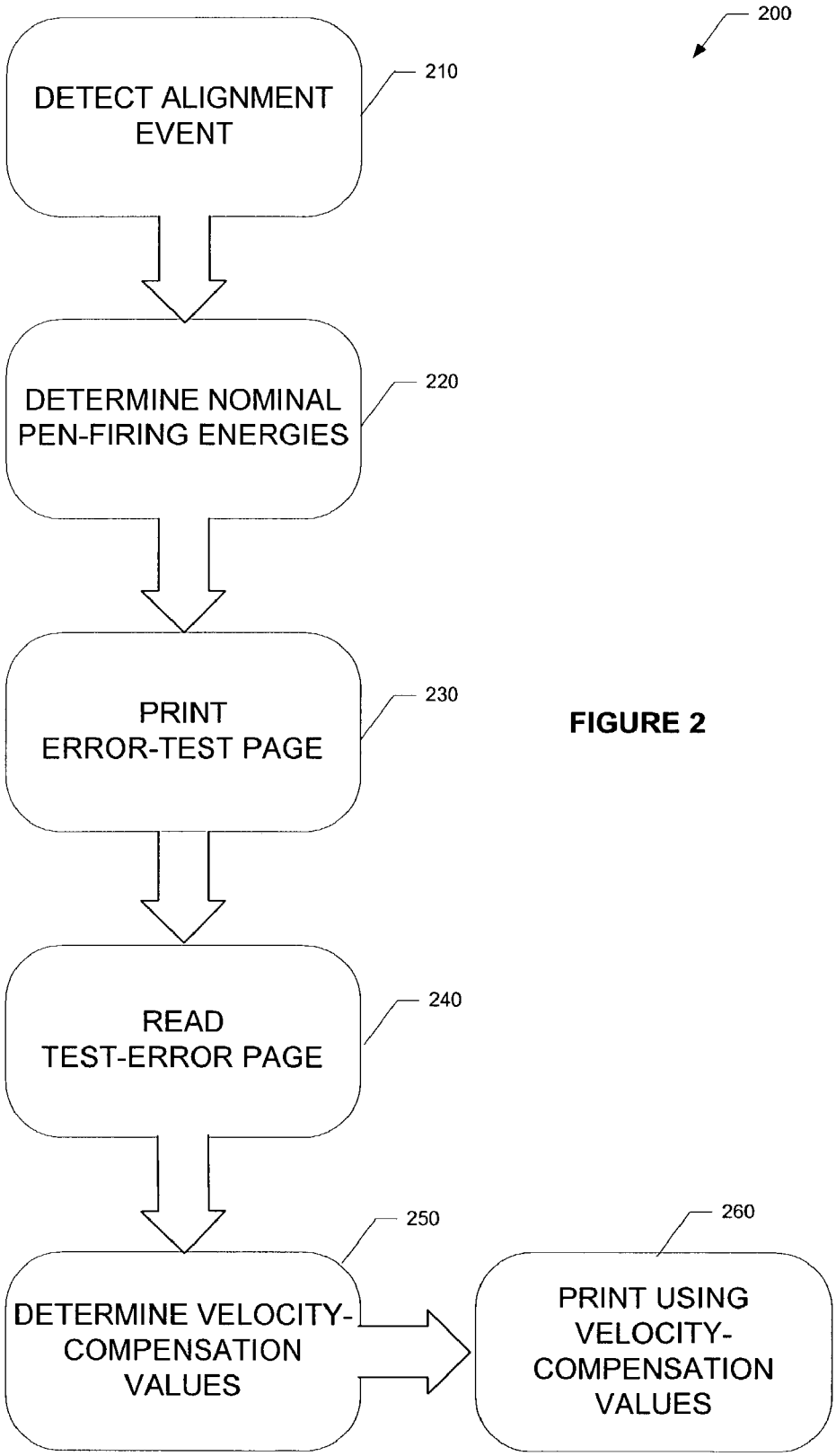
FIG. 2 is a flow chart of an exemplary method corresponding to one or more embodiments of the present invention.

More particularly, FIG. 2 shows a flow chart 200 of one or more exemplary methods at least partly embodied within control module (specifically error-reduction software 1245) and executed by processor 1241 and other relevant portions of system 100. Flow chart 200 includes blocks 210–260, which are arranged and executed serially in the exemplary embodiment. However, other embodiments execute two or more blocks in parallel using multiple processor or processor-like devices or a single processor organized as two or more virtual machines or subprocessors. Other embodiments also alter the process sequence or provide different functional partitions to achieve analogous results. Moreover, still other embodiments implement the blocks as two or more interconnected hardware modules with related control and data signals communicated between and through the modules. Thus, the exemplary process flow applies to software, hardware, and firmware implementations.

In block 210, the exemplary method begins with detection of an alignment (or more generally a compensation) event. In the exemplary embodiment, detection occurs with installation of a new printhead (or new pens). However, other embodiments treat the invocation of certain high-resolution print modes or loading of particular forms of print media as alignment events. The exemplary method then continues at block 220.

Block 220 entails determining the nominal pen-firing energies (or nominal over energies) for each of the pens in the printhead. The exemplary embodiment determines these nominal pen-firing energies by first determining the minimum firing-pulse amplitude at which each pen will eject ink drops, using a conventional technique, such as electrostatic-drop detection (EDD.) (See, for example, U.S. Pat. No. 6,454,376 (Su et al.), which is assigned to the same assignee as the present application and incorporated herein by reference.) This entails holding the firing-pulse duration constant and increasing or decreasing the pulse amplitude from some starting voltage until some minimum drop-production criteria, such as temperature or drop count, is met. The product of the fixed pulse width and the pulse amplitude that satisfies the minimum drop-production criteria is the minimum pen-firing energy.

The exemplary method then sets the nominal pen-firing energy for each pen at an energy greater than the minimum pen-firing energy for that pen in an attempt to achieve substantially consistent drop production. For example, the nominal pen-firing energy for each pen can be set to 110–120% of the minimum pen-firing energy. However, other embodiments use other percentages and even pen-specific percentages. Still other embodiments set the drop-production threshold at a sufficiently high level to allow use of the minimum pen-firing energy or even a "less than minimum" pen-firing energy as the nominal pen-firing energy.

Once the nominal pen-firing energies are determined, they are stored in memory for future use. Since the pulse durations for each pen are substantially identical in the exemplary embodiment, the nominal pen-firing energies are stored in memory as a table of pen identifiers and corresponding nominal turn-on-voltages (TOVs). TOV is the amplitude of the pulse corresponding to the nominal pen-firing energy. (Some embodiments use pulses of differing durations to establish the nominal pen-firing energies and thus store whatever information may be need to indicate the nominal pen-firing energies.) Each of the nominal pen-firing energies results in ejection of drops at a corresponding nominal drop-ejection velocity. (Note that the drop-ejection velocity of each pen is fixed relative to the other pens in this process.) After recording the nominal pen-firing energies (or voltages), execution continues at block 230.

Block 230 entails automatic printing of one or more error-test pages based on the error-test page data 1244 in memory 1243 (in FIG. 1). In one exemplary embodiment, printing the error-test page entails printing three sets of test images, one for each of three selected non-reference pens. Each set of test images includes two or more test images (or patterns) that are printed using a reference pen at its nominal pen-firing energy (or corresponding drop-ejection velocity) and the corresponding non-reference pen at one or more pen-firing energies different from its nominal pen-firing energy. Thus, each test images includes features printed at different relative drop-ejection velocities.

Figure 3:
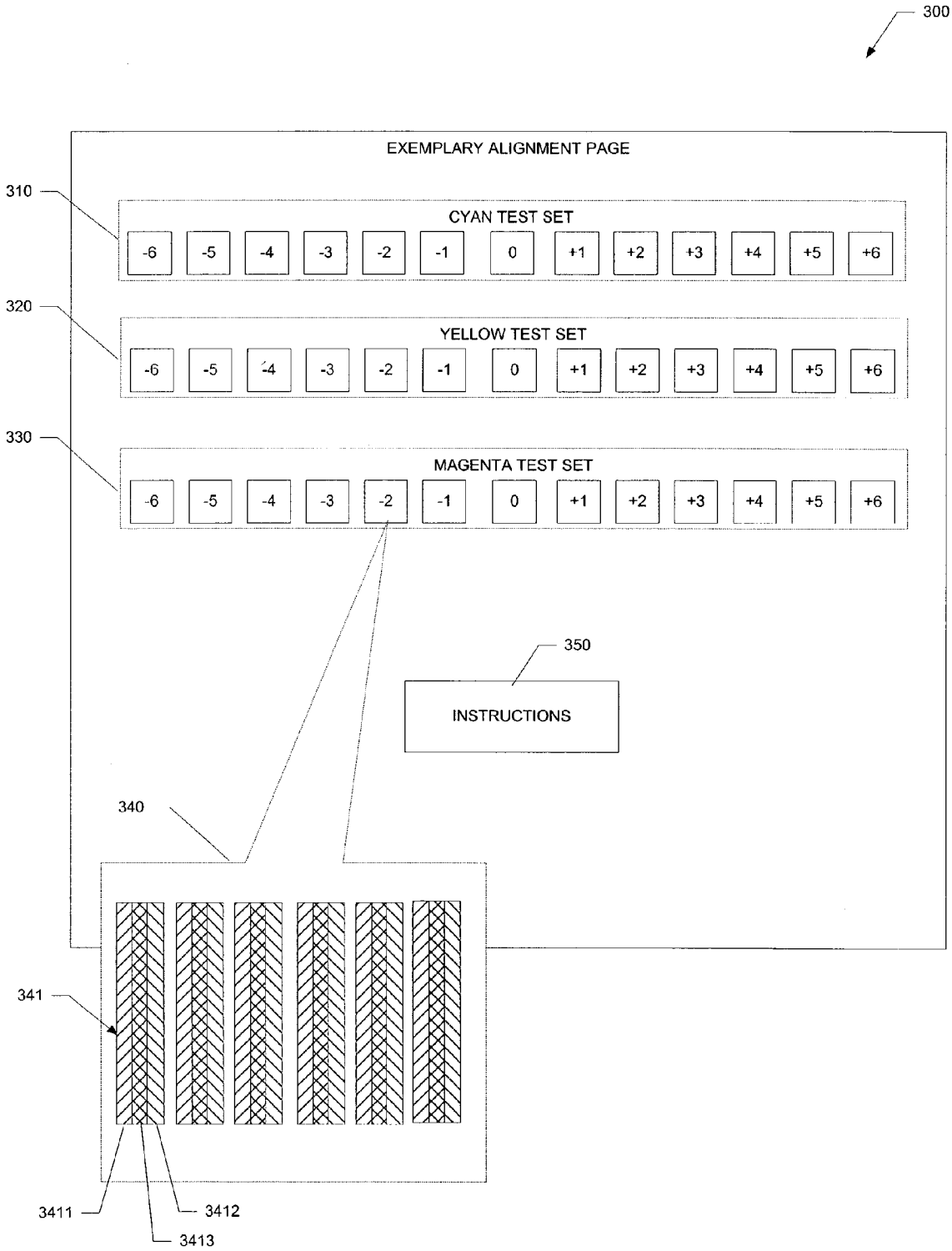
FIG. 3 is a block diagram of an exemplary error-test page 300 corresponding to one or more embodiments of the present invention.

More particularly, FIG. 3 shows an exemplary error-test page 300, which includes three sets of test images 310, 320, and 330, one for each of the three colors pens: cyan (C), yellow (Y), and magenta (M). Each set of test images, of which test image set 310 is representative, includes a sequence of 13 images respectively designated −6, −5, −4, −3, −2, −1, 0, +1, +2, +3, +4, +5, and +6. Each designation indicates a percentage deviation from the nominal pen-firing energy (or drop-ejection velocity) for the corresponding (non-reference) pen used to produce the test image. Thus, for example, the −6 image in set 310 was produced by decreasing the amount of energy applied to the cyan pen by 6% from its nominal pen-firing energy. The energy deviation can be achieved by altering the width and/or amplitude of the electrical pulses applied to the heating element (such as a resistor) in the corresponding pen. Some embodiments that alter the pulse width limit its deviations to plus-or-minus ten percent of a nominal pulse width (or duration).

Each exemplary test image, of which test image 340 is representative, includes a set of one or more pairs of vertical bars, of which pair 341 is representative. Pair 341 includes a reference bar 3411 printed using the reference pen (such as the black pen) at its nominal pen-firing energy and a non-reference bar 3412 printed using a non-reference pen (such as the magenta pen) at a pen-firing energy, such as an energy 2% less than its corresponding nominal pen-firing energy. Non-reference bar 3412 overlaps reference bar 3411 at an overlap region 3413. The size or other characteristic of the region is indicative of the relative alignment of the non-reference pen with the reference pen, in this case the magenta pen with the black pen.

If the pens are aligned exactly in the test image, the non-reference bars completely cover the reference bar and exhibit a color based on the combination of the colors of the reference and non-reference pens. Thus, for example, if the reference bar is black and the non-reference bar is magenta, the degree of misalignment is represented by the amount of visible magenta, with no visible magenta indicating exact alignment. If the test image is formed using two non-black colors, exact alignment manifests as a composite color, and misalignment manifests as three bands of colors: the reference color, a non-reference color, a composite of the reference and non-reference colors (assuming misalignment was not so great as to result in complete separation of the printed bars.)

Although the exemplary embodiment uses vertical bars in its test images, some embodiments use test images having features other than vertical bars. For example, some embodiments use arrays of printed dots or crosses, and/or other patterns that facilitate colorimic, optical, visual, and/or other methods of determining of relative degrees of misalignment. And, still other embodiments may print lines or other features and measure the distances between them to determine relative alignment. Moreover, some embodiments may use different test images and/or test features for each pen.

Error-test page 300 may also include user instructions 350. Some other embodiments display the user instructions on a status or command window (not shown) on the printer itself or on a display device coupled to and/or controlled by the printer or computer.

Test-error page 300 is based on control data stored in test-error page 1244 in memory 1243. (As such, page 300 is also representative of a data structure.) The exemplary embodiments stores the control data in the form of relative energy deviations (that is, relative to the corresponding nominal pen-firing energies. However, some embodiments store the control data in the form of absolute energy parameters, or in the form of absolute or relative turn-on-voltage parameters and/or a pulse-width parameters. In these cases, the error-reduction software (more precisely the processor executing the software) responds to the control data by applying appropriate control signals to the pulse generator to achieve the desired adjustments to the pen- firing energies. Still other embodiments may store the control data in the form of absolute or relative drop-ejection velocities, which can be translated into appropriate control signals.

After printing the error-test page at block 230 (in FIG. 2), execution of the exemplary method continues at block 240, which entails reading the printed error-test page. To this end, the exemplary embodiment scans or digitizes the printed error-test page at a resolution of 600 dpi. This entails a user placing and orienting the alignment page on scanner 121 (in FIG. 1) and initiating or allowing scanning of the alignment page, according to instructions 350 on the alignment page (FIG. 3). Exemplary instructions instruct the user to push or actuate a button or other device on the scanner or an associated graphical user interface for host system 110 (of FIG. 1). In some embodiments, the scanning occurs in a device outside of printer 120. Some other embodiments use a carriage-spot sensor, rather than a scanner, to read the error-test page. Execution continues at block 250.

Block 250 entails determining velocity-compensation values from the LHC color-space data read from the error-test page. The exemplary embodiment determines these values using one of two general techniques.

The first technique is to identify which of the test images associated with each pen exhibits the best pen-to-pen alignment based on an alignment parameter. Once the best test image (or tile) is identified, the pen-firing velocity, or more specifically the pen-firing energy associated with this identified or found test image, is then associated with the given non-reference pen for use during high-resolution or enhanced-resolution printing.

More specifically, the exemplary embodiment defines the alignment parameter in terms of standard luminocity deviation and computes the standard deviation based on the measured luminocities of the pixels for each a test image. Once the standard deviations are determined, this embodiment sorts or searches the standard luminocity deviations to find the minimum luminosity deviation, and then assigns the pen-firing energy (or drop-ejection velocity) associated with the corresponding test image having the best alignment. (Some embodiments define the alignment parameters using other measures of central tendency or dispersion, such as variance or higher-order statistical moments.) This search procedure is repeated for each pen to develop a complete set of pen-firing energies.

The second technique, which generally determines optimal, desired drop-ejection velocities (or corresponding pen-firing energies) with a greater precision than the first technique, entails using an error-reduction procedure, such as a least-squares-error procedure, to define an "alignment parameter versus pen-firing-energy curve" that best fits the measured alignment parameters, for example the standard luminosity deviations, for the test images associated with a given pen. The best-fit curve is then used to determine what drop-ejection velocity or corresponding pen-firing energy minimizes the alignment parameter and this velocity or energy is then assigned for use with the corresponding pen during, for example, high- or enhanced-resolution printing.

Figure 4:
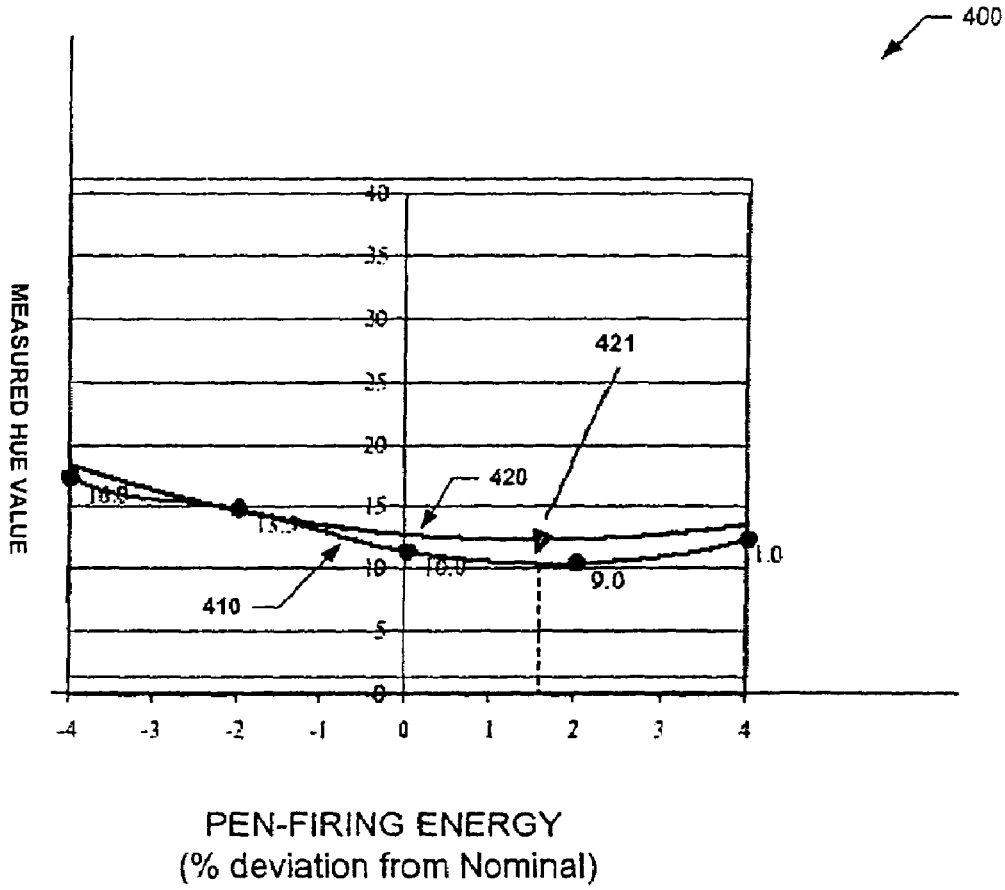
FIG. 4 is a Cartesian graph of an alignment-parameter values versus pen-firing energy or drop-ejection velocity corresponding to one or more embodiments of the present invention.

For example, FIG. 4 shows a graph 400 which includes plots 410 and 420 of a alignment parameter, such as hue value or standard luminosity deviation, versus pen-firing energy (or more precisely energy or velocity deviation relative to the nominal pen-firing energy for the corresponding pen.) Graph 410 is a curve drawn through the measured alignment parameters from test images for one of the pens, and graph 420 represents a best-fit curve for the alignment data in terms of a minimized least-square error. The exemplary embodiments fits a sinsusoidal curve to the data; however, other embodiments may use other types of curves, including for example, lines, parabolas, and so forth. Graph 420 has a minimum alignment measurement at point 421, which corresponds to a relative pen-firing energy value of about +2.5 percent at 421. This minimizing velocity or pen-firing energy is then assigned for use with the corresponding pen during high- or enhanced-resolution printing.

Some embodiments may define the alignment parameter as a measure of alignment rather misalignment. In these cases, one would seek to find the pen-firing energy that maximized the alignment parameter rather than minimized it for the corresponding pen. Other embodiments may allow the user to identify and select the test image exhibiting the best apparent alignment for each pen. In these embodiments, the user is asked to select from the entire set of printed test images or from a subset of the printed test images, with the subset determined by the error-reduction software. In some variants of these embodiments, the test images are displayed in an enlarged or magnified form on a printer-control display or on a display associated with the host system.

After determining the velocity-compensation values for each pen, the exemplary method records the values in a memory, such as a non-volatile portion of memory 1243 in printer 120 (FIG. 1), for use during appropriate print and/or copy modes, for example, high-or enhanced-resolution printing modes. However, some embodiments record the velocity-compensation values in memory in printhead 123 or within host system 110. Execution of the exemplary method then advances from block 250 to block 260.

Block 260 entails applying the stored velocity-compensation values during printing to reduce print errors related to pen-to-pen misalignment, paper-shape variation or other print errors correctable by modulating relative or absolute drop-ejection velocities. In the exemplary embodiment, this entails receiving normal render data from host system 110 at a first resolution, such as 1200 dpi, and then determining whether an enhanced print-mode is in effect. If an enhanced or higher-resolution print mode is in effect, the exemplary embodiment fetches the velocity-compensation values and uses these values to alter the relative and/or absolute drop-ejection velocities (or corresponding pen-firing energies) during printing to achieve an effective resolution, such as 4800 dpi, which is greater than the first resolution. If the high- or enhanced resolution mode is not in effect, the exemplary embodiment uses the nominal drop-ejection velocities (or corresponding nominal pen-firing energies) for each of the pens. Some other embodiments use the velocity-compensation values for all print modes.

Figure 5:
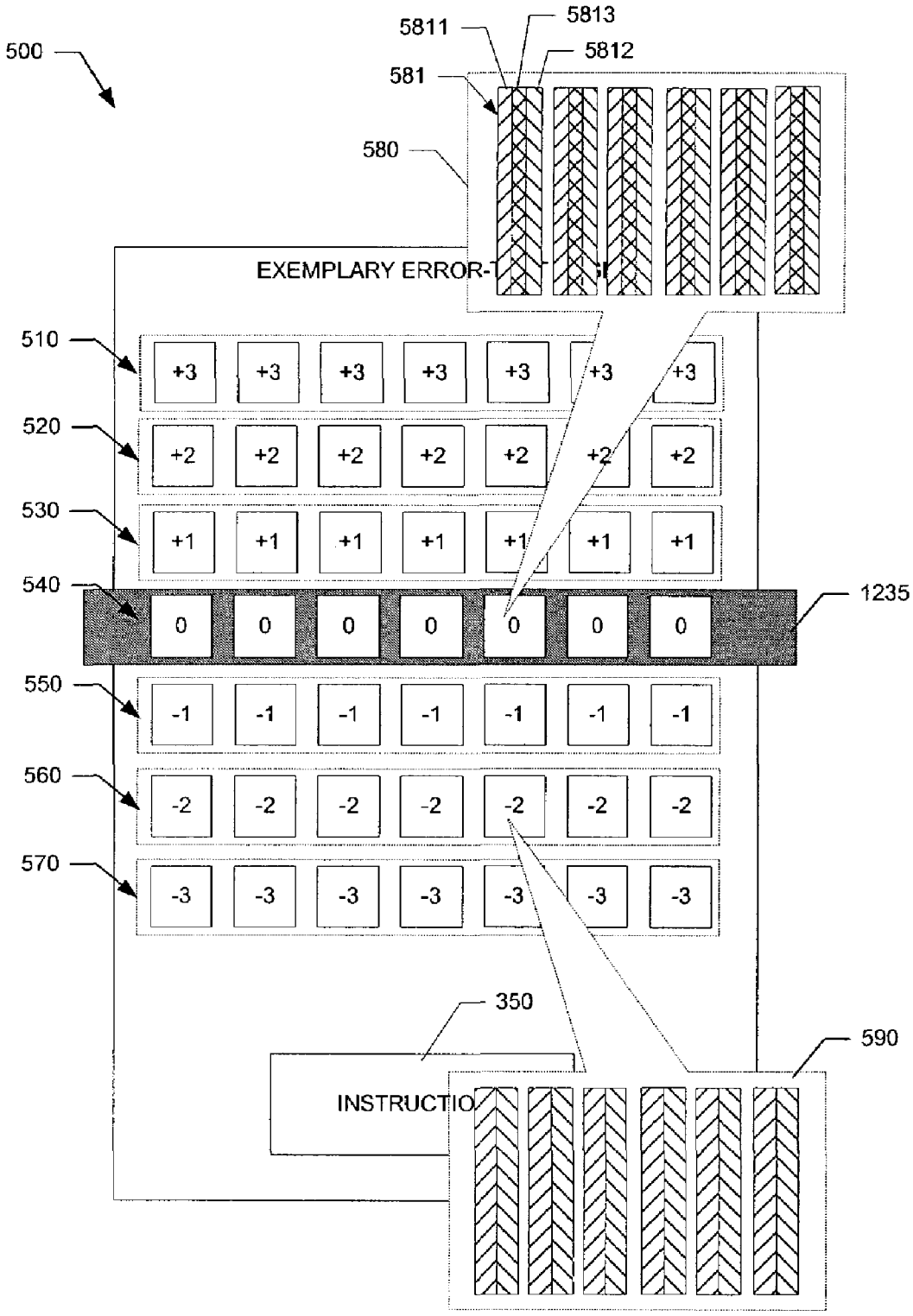
FIG. 5 is a block diagram of another exemplary alignment page 500 corresponding to an one or more embodiments of the present invention.

FIG. 5 shows another exemplary error-test page 500 (also representative of a data structure in memory 1243), which can be used separately or together with error-test page 300 (in FIG. 3) Error-test page 500 includes a number of sets (or rows) of test images 510–570, with each image in each set evidencing some degree of paper-shape variation based on the position of the printhead within print zone 1235 (shown originally in FIG. 1, and reproduced here for convenience) at the time of printing. For example, set 510 includes similarly formatted images that are all designated "+3" in the figure to indicate that each resulted from using one or more pens at a corresponding set of pen-firing energies or drop-ejection velocities, with each energy or velocity being three percent greater than the reference energy or velocity for the given pen. In other words, the energy or velocity for each pen deviates in the same relative or proportional amount from its respective reference energy as the other pens. (Varying all the energies or velocities of all the pens in this way maintains the relative energies and velocities and thus preserves the alignment relation of their printed dots, assuming that any paper-shape variation affects all the relevant pens similarly.) Examples of suitable references include the nominal pen-firing energies or the alignment-compensated pen-firing energies derived from the error-test page 300. Similarly, sets 520–570 include images produced with respective energy or velocity deviations of +2, +1, 0, −1, −2, and −3; percent relative to the reference energies or velocities.

Each exemplary test image, of which test image 580 is representative, includes a set of one or more pairs of printed vertical bars. A pair 581, which is generally representative of the pairs in all the test images, includes bars 5811 and 5812, which were printed using two pens at their respective reference energy or velocity. An interference or overlap bar 5813, designated by the intersecting cross-hatches, reveals the presence of a variation in a paper-to-printhead distance within the region of print zone 1235 corresponding to the position of test image 580. (The exemplary embodiment assumes that paper shape is substantially invariant or negligibly variant within the region the print zone corresponding to each test image. The validity of this assumption generally varies inversely with the size of the region.) The degree of paper-shape variation is indicated by a width of the overlap bar, or in the case of a complete separation (non-intersection) of bars 5811 and 5812, the width of the separation. Some embodiments may deliberately overlap or intersect the bars and treat the level of non-overlap or separations as a measure of alignment.

Once error-test page 500 is printed, the exemplary method continues at block 240 with reading the error-test page and at block 250 with determination of the velocity-compensation values In the exemplary embodiment, determination of the velocity-compensation values for errors related to the paper-shape variation follows a procedure to similar to that used for determining the velocity-compensation values for pen-to-pen misalignment.

Specifically, the exemplary embodiment determines these values using one of two general techniques. The first technique initially identifies which of the test images in set 540 (the set produced using the reference velocities or energies) exhibits paper-shape variation as evidenced by the overlap or separation of the vertical bars in each pattern (or some other paper-shape indicator(s)). Each of these identified test images corresponds to a particular horizontal region of the print zone as well as to a column set of test images in the error-test page, which also corresponds to the same print region. For example, test image 580, which has overlap region 5813, corresponds to a column set of test images 590. Column set 590 includes test images designated +3, +2, +1, −1, −2, and −3 in addition to test image 580, which is designated '0'.

The search technique then entails identifying which of the test images in the column set of images has the least amount of paper-shape variation as evidenced by for example, the least amount of overlap or the least amount of separation. The overlap can be determined, for example, using the standard luminocity deviation, or other colorimic, optical, or visual procedure as described earlier. As an example, FIG. 5 shows that one of the test images in column set 590, specifically a test image 591, includes vertical columns with no overlap or separation. This image was produced using pens at −2 percent velocity or energy deviation, Thus, based on this search result the exemplary embodiment associates the region of print zone 1235 corresponding to column set 590 with the −2 percent velocity or energy deviation that was used to produce test image 591. This image-search procedure is generally repeated for each column in the printed error-test page that evidences significant paper-shape variation, and yields a set of velocity-compensations that can be used when printing in the corresponding regions of a print zone to reduce printing errors, such as drop-placement errors, stemming from paper-shape variations within the regions.

Some embodiments search each column set of test images for the test image exhibiting the best alignment and associate that test image with the corresponding region of the print zone. Other embodiments transpose the error-test page to allow one to compensate for paper-shape variation in vertical dimension Y.

The second technique, which determine optimal pen-firing velocities (or corresponding pen-firing energies) with a greater precision than the first technique, entails using an error-reduction procedure, such as least-squares-type procedure, to define a "paper-shape parameter versus pen-firing-energy curve" that best fits the paper-shape (or more generally alignment) measurements for the test images in each column set of test images or in each column set evidencing significant dot-placement errors. The fitted curve is then used to determine what specific drop-ejection velocity or corresponding pen-firing energy (or range of velocities and energies) best reduces or minimizes the printing errors, such as drop-placement errors, based on paper-shape variations exhibited in the corresponding region of the print zone. This procedure is generally repeated for each column in the printed error-test page that evidences significant paper-shape variation, thus yielding a set of velocity-compensation values that can be used when printing in the corresponding regions of a print zone to reduce printing errors, such as drop-placement errors, stemming from paper-shape variations within the regions.

CONCLUSION

In furtherance of the art, the inventors have presented various exemplary systems, methods, software, and data structures for use in reducing print errors stemming from mechanical imperfections, such as pen-to-pen misalignment and/or paper shape variation. One exemplary method adjusts the drop-ejection velocity of one ink-jet pen relative to that of another ink-jet pen to compensate for a misalignment of the pens. Another exemplary embodiment adjusts the drop-ejection velocities of two or more pens in the printhead by a relative amount based on position of the printhead within a print zone. And yet another embodiment adjusts the relative pen-to-pen drop-ejection velocities of one or more pens in a printhead and the absolute drop-ejection velocities of all the pens in the printhead based on position of the printhead within a print zone. Various embodiments adjust drop-ejection velocities by modulating the pen-firing energies of ink-jet pens.

The embodiments described above and in the following claims are intended only to illustrate and teach one or more ways of practicing or implementing one or more exemplary embodiments of the present invention, not to restrict its breadth or scope. The actual scope of the invention, which embraces all ways of practicing or implementing the teachings of the invention, is defined only by the following claims and their equivalents.

The invention claimed is:

1. A method comprising:

changing a drop-ejection velocity of an ink-jet pen based on a position within a print zone to compensate for paper-shape variations.

2. The method of claim 1, wherein changing the drop-ejection velocity comprises changing a pen-firing energy applied to the ink-jet pen.

3. The method of claim 2, wherein changing the pen-firing energy comprises changing an amplitude of an electrical pulse applied to the ink-jet pen.

4. The method of claim 2, wherein changing the pen-firing energy comprises changing duration of an electrical pulse applied to the ink-jet pen.

5. The method of claim 1, wherein changing the drop-ejection velocity comprises changing a pen-firing energy applied to the ink-jet pen to reduce drop-placement errors based on misalignment of the ink-jet pen with another ink-jet pen.

6. The method of claim 5, wherein changing the pen-firing energy to reduce drop-placement errors based on misalignment of the ink-jet pen with another inkjet pen, comprises:

printing a set of two or more test images, with each test image printed using a different pen-firing energy than other test images in the set;

determining a first pen-firing energy based on the printed set of test images; and applying the first pen-firing energy to the ink-jet pen.

7. The method of claim 6, wherein determining the first pen-firing energy based on the printed set of test images, comprises:

determining a minimum value based on the printed set of test images; and determining the first pen-firing energy based on the determined minimum value.

8. The method of claim 7, wherein the determined first drop-ejection value differs from any of the pen-firing energies used to print the set of test images.

9. The method of claim 6, wherein applying the pen-firing energy to the inkjet pen, comprises:

sensing invocation of a print mode having an associated print resolution; and applying the first pen-firing energy to the inkjet pen in response to sensing invocation of the print mode.

10. The method of claim 1, wherein changing the drop-ejection velocity comprises changing a pen-firing energy to reduce drop-placement errors based on variation in a paper-shape.

11. The method of claim 10, wherein changing the pen-firing energy to reduce drop-placement errors based on variation in a paper shape, comprises:

printing a set of two or more test images, with each test image printed using a different pen-firing energy than other test images in the set; and determining a first pen-firing energy based on the printed set of test images;

applying the first pen-firing energy to the ink-jet pen.

12. The method of claim 11, wherein determining the first pen-firing energy based on the printed set of test images, comprises:

determining a minimum value based on the printed set of test images; and determining the first pen-firing energy based on the determined minimum value.

13. The method of claim 10, wherein the determined first pen-firing energy differs from any pen-firing energy used to print the set of test images.

14. The method of claim 10, wherein applying the first pen-firing energy to the inkjet pen comprises:

sensing invocation of a print mode having an associated print resolution; and changing the drop-ejection velocity of the one ink-jet pen to the first drop-ejection velocity in response to sensing invocation of the print mode.

15. A computer-readable medium comprising instructions for:

changing a drop-ejection velocity of an ink-jet pen based on a position within a print zone to compensate for paper-shape variations.

16. The medium of claim 15, wherein the instructions for changing the drop-ejection velocity comprise instructions for changing a pen-firing energy applied to the ink-jet pen.

17. The medium of claim 16, wherein the instructions for changing the pen-firing energy to reduce drop-placement errors, comprise instructions for:

printing a set of two or more test images, with each test image printed using a different pen-firing energy than other test images in the set; and determining a first pen-firing energy based on the printed set of test images;

applying the first pen-firing energy to the ink-jet pen.

18. The medium of claim 17, wherein the instructions for determining the first pen-firing energy based on the printed set of test images, comprise instructions for:

determining a minimum value based on the printed set of test images; and determining the first pen-firing energy based on the determined minimum value.

19. The medium of claim 18, wherein the determined first pen-firing energy differs from any pen-firing energy used to print the set of test images.

20. A system comprising:

a printhead having at least first and second ink-jet pens and being movable relative to a print zone; and means for changing a drop-ejection velocity of the first ink-jet pen relative to a drop-ejection velocity of the second ink-jet pen based on a position within a print zone to compensate for pen-to-pen misalignment.

21. The system of claim 20, further comprising:

means for changing the drop-ejection velocities of the first and second ink-jet pens based on position of the printhead within the print zone.

22. The system of claim 20, wherein the means for changing the drop-ejection velocity includes means for changing relative duration or amplitude of electrical pulses associated with the first or second ink-jet pens.

23. The system of claim 21, wherein the means for changing the drop-ejection velocities of the first and second ink-jet pens maintains relative drop-ejection velocities of the first and second ink-jet pens.

* * * * *